US007947891B2

(12) United States Patent
Nakae

(10) Patent No.: US 7,947,891 B2
(45) Date of Patent: May 24, 2011

(54) RESONANCE TONE GENERATING APPARATUS AND ELECTRONIC MUSICAL INSTRUMENT

(75) Inventor: Tetsuichi Nakae, Ome (JP)

(73) Assignee: Casio Computer Co., Ltd., Tokyo (JP)

( * ) Notice: Subject to any disclaimer, the term of this patent is extended or adjusted under 35 U.S.C. 154(b) by 116 days.

(21) Appl. No.: 12/418,789

(22) Filed: Apr. 6, 2009

(65) Prior Publication Data

US 2009/0266219 A1 Oct. 29, 2009

(30) Foreign Application Priority Data

Apr. 28, 2008 (JP) ..... 2008-116875

(51) Int. Cl.
*G10H 1/00* (2006.01)

(52) U.S. Cl. ..... 84/626; 84/630; 84/662; 381/63; 708/300; 708/315

(58) Field of Classification Search ..... 84/600–602, 84/626, 630, 662; 381/63; 708/300, 301, 708/31, 315, 318
See application file for complete search history.

(56) References Cited

U.S. PATENT DOCUMENTS 3,872,290 A * 3/1975 Crooke et al. ..... 708/315
4,695,969 A * 9/1987 Sollenberger ..... 708/323
4,866,648 A * 9/1989 Usui ..... 708/300
4,888,811 A * 12/1989 Takashi ..... 381/111
5,025,472 A * 6/1991 Shimizu et al. ..... 381/63
5,046,004 A * 9/1991 Tsumura et al. ..... 84/601
5,432,856 A * 7/1995 Shioda ..... 381/63
5,455,380 A * 10/1995 Matsuda et al. ..... 84/662
5,569,870 A * 10/1996 Hirano ..... 84/615
5,717,727 A * 2/1998 Yamada et al. ..... 375/350
6,058,404 A * 5/2000 Mahant-Shetti et al. ..... 708/301
6,519,342 B1 * 2/2003 Opitz ..... 381/61
6,563,869 B1 * 5/2003 Yamada ..... 375/232
6,937,669 B2 * 8/2005 Tomerlin et al. ..... 375/297
7,612,281 B2 * 11/2009 Nakae ..... 84/630
2005/0244019 A1 11/2005 Lallemand
2009/0000462 A1 * 1/2009 Fujita ..... 84/604
2009/0266219 A1 * 10/2009 Nakae ..... 84/229

FOREIGN PATENT DOCUMENTS

JP 5-188950 A 7/1993

(Continued)

OTHER PUBLICATIONS

Japanese Office Action dated Apr. 13, 2010 and English translation thereof in counterpart Japanese Application No. 2008-116875.

*Primary Examiner* — David S. Warren
(74) *Attorney, Agent, or Firm* — Holtz, Holtz, Goodman & Chick, PC

(57) ABSTRACT

A product-sum operation circuit has delay circuits of the first to the (n−1)th stage for delaying musical tone data, multiplying circuits 60-6(n−1) for multiplying the musical signal data or the delayed musical signal data output from the delay circuits by impulse response coefficients, and adders 71-7(n−1) for summing up data output from the multiplying circuits. The product-sum operation circuit is provided with a feed back circuit. The feed back circuit includes a multiplying circuit 80 that receives the delayed data from the delay circuit at the (n−1)th stage and multiplies the received data by a multiplication coefficient, and an adder 81 for adding data from the multiplying circuit 80 to the delayed data from the delay circuit at the "p"th stage.

9 Claims, 10 Drawing Sheets

FOREIGN PATENT DOCUMENTS

| | | | |
|---|---|---|---|
| JP | 9-026788 | A | 1/1997 |
| JP | 9-090967 | A | 4/1997 |
| JP | 2692672 | B2 | 9/1997 |
| JP | 2005-534992 | T | 11/2005 |
| JP | 2005-338471 | A | 12/2005 |
| JP | 2007-193129 | A | 8/2007 |

* cited by examiner

RESONANCE TONE GENERATING APPARATUS AND ELECTRONIC MUSICAL INSTRUMENT

CROSS-REFERENCE OF RELATED APPLICATION

The present application is based on and claims the benefit of priority from the prior Japanese Patent Application No. 2008-116875, filed Apr. 28, 2008, the entire contents of which are incorporated herein by reference.

BACKGROUND OF THE INVENTION

1. Field of the Invention

The present invention relates to a resonance tone generating apparatus for generating resonance tones of musical signals and an electronic musical instrument provided with the resonance tone generating apparatus.

2. Description of the Related Art

An electronic musical instrument is well known, which is provided with a damper pedal and changes a musical tone in response to operation of pressing down the damper pedal. In particular, resonance tone adding apparatuses are proposed, which generate resonance tone data based on musical signal data and add the generated resonance tone data onto the musical signal data in response to operation of the damper pedal.

In general, the above resonance tone adding apparatus receives digital musical signal data and performs a filtering process on the received musical signal data using a digital filter, thereby generating resonance tone data. In the filtering process, FIR (Finite Impulse Response) filter and/or IIR (Infinite Impulse Response) filter are used.

When FIR filter is used, a convolution operation is performed on supplied musical signal data $x(n-k)$, where "k"=0, 1, . . . , (n−1), and impulse response data $a(k)$ acquired from reverberation characteristics of a concert hall, whereby resonance tone data $Y(n)=\Sigma\times(n-k)\times a(k)$ can be obtained.

U.S. Pat. No. 5,569,870 discloses an electronic musical instrument that changes an envelop of musical signal data depending on a position of a pressed damper pedal, and generates a musical tone particularly when the damper pedal is pressed down half way.

Japanese Patent No. 2,692,672 discloses a technique, in which a resonance tone generating apparatus generates resonance tone data RWD based on waveform data SWD corresponding to a musical tone waveform, and a multiplier adjusts an amplitude level of the waveform data AWD to decrease during the course of pedal data increasing from the minimum value "0" to the maximum value "1", wherein the pedal data indicates how much the damper pedal has been pressed down and is detected when said damper pedal is pressed down, and further the multiplier adjusts the resonance tone data RWD generated by the resonance tone generating apparatus to increase.

Particularly, resonance tones of a piano are complex and a technique for generating resonance tones of piano strings has been proposed.

In Japanese Patent Application No. 2007-193129 A is proposed a technique that is provided with groups of plural string resonance circuits (digital filters) each having resonance frequencies corresponding to harmonic tones of each letter notation and performs the convolution operation on data output from each string resonance circuit, thereby generating a resonance tone similar to a string resonance tone of the piano.

In electronic musical instruments, resonance tones including reverberation sounds generated when the damper pedal is pressed down cannot be reproduced simply by changing an envelop of musical signal data as disclosed in U.S. Pat. No. 5,569,870.

Further, in the technique disclosed in Japanese Patent No. 2,692,672, a mixing ratio of the musical tone to resonance tone is changed by a so-called cross-fade technique, but the technology has a disadvantage that, since the resonance tone itself does not change, change of the resonance tone due to pressing operation of the damper pedal is poor.

Further, in the technique disclosed in Japanese Patent Application No. 2007-193129 A, since plural string resonance tone generating circuits are provided for each keyboard zone, such disadvantage is invited that a large scale of circuit is required. Further, since the resonance tone is not produced in consideration of a piano structure, another disadvantage is invited that a sufficient resonance tone cannot be reproduced even though the large scale of circuit is employed.

SUMMARY OF THE INVENTION

It is an object of the present invention to provide a resonance tone generating apparatus for generating resonance tones of musical signals and an electronic musical instrument provided with the resonance tone generating apparatus.

According to one aspect of the invention, there is provided a resonance tone generating apparatus for generating resonance tone data to be applied to musical signal data, which apparatus comprises an impulse response data storing unit for storing impulse response data including impulse response coefficients, wherein the impulse response coefficient indicates an impulse response characteristic and is defined by a value on a time axis, a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients; and plural adder units for summing up data output from the multiplying units, and a feed back unit for feeding back first delayed musical signal data output from the product-sum operation unit to the product-sum operation unit, wherein the feed back unit comprises a multiplying unit for multiplying the first delayed musical signal data output from the product sum operation unit by a multiplication coefficient to obtain multiplication data and an adder unit for summing up second delayed musical signal data output from the product-sum operation unit and the multiplication data obtained by the multiplying unit of the feed back unit.

According to another aspect of the invention, there is provided an electronic musical instrument, which comprises a key board having plural keys, a damper pedal for generating a signal indicating a state of pressed pedal when the damper pedal is pressed down, a tone producing unit for producing musical signal data of a pitch corresponding to a pressed key of the key board, when the key of the key board is pressed, an impulse response data storing unit for storing impulse response data including impulse response coefficients, wherein the impulse response coefficient indicates an impulse response characteristic and is defined by a value on a time axis, a product-sum operation unit for performing a product-sum operation on a series of musical signal data on the time axis and impulse response coefficients read from the impulse response data storing unit, thereby producing resonance tone data, wherein the product-sum operation unit comprises a delay unit for delaying the musical signal data produced by the tone producing unit, a multiplying unit for multiplying one of the musical signal data and delayed musical signal data output from the delay unit by the impulse response coefficients, and an adder unit for summing up data output from the multiplying unit, a feed back unit for feeding back first delayed musical signal data output from the delay unit of the product-sum operation unit to the product-sum operation unit, wherein the feed back unit comprises a multiplying unit for multiplying the first delayed musical signal data output from the delay unit of the product-sum operation unit by a multiplication coefficient to obtain multiplication data, and an adder unit for summing up second delayed musical signal data output from the delay unit of the product-sum operation unit and the multiplication data obtained by the multiplying unit of the feed back unit, and a combining unit for combining the musical signal data produced by the tone producing unit and the resonance tone data produced by the product-sum operation unit.

DETAILED DESCRIPTION OF THE PREFERRED EMBODIMENTS OF THE INVENTION

Figure 1:
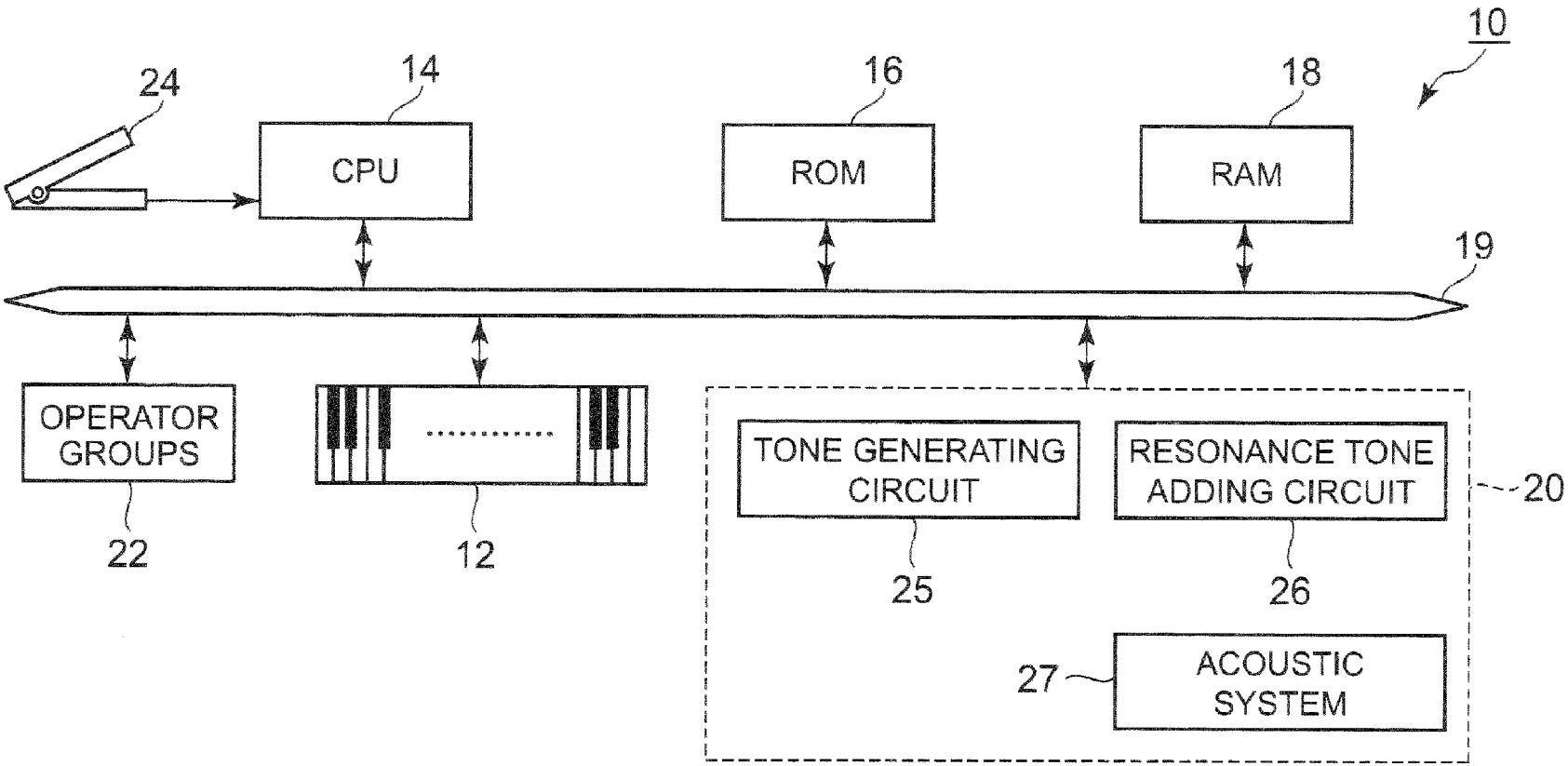
FIG. 1 is a block diagram illustrating a configuration of an electronic musical instrument according to the first embodiment of the invention.

Now, the first embodiment of the present invention will be described in detail with reference to the accompanying drawings. FIG. 1 is a block diagram illustrating a configuration of an electronic musical instrument according to the first embodiment of the invention.

The electronic musical instrument 10 according to the first embodiment of the invention comprises a key board 12, CPU 14, ROM 16, RAM 18, musical tone producing unit 20 and operator group 22, the elements being connected with each other through a bus 19, as shown in FIG. 1. Further, the musical tone producing unit 20 comprises a tone generating circuit 25, resonance tone adding circuit 26 and acoustic system 27. The electronic musical instrument 10 according to the present embodiment is capable of producing various musical tones such as tones of a piano, violin, guitar, etc.

The key board 12 transmits to CPU 14 information for specifying a pressed key and information indicating a velocity of the pressed key in response to a key pressing operation by a player.

CPU 14 controls operation of the whole electronic musical instrument 10 and generates various control signals to be supplied to the musical tone producing unit 20 to generate a musical tone of a pitch corresponding to the pressed key. ROM 16 stores a program, constants used for running the program, waveform data, which is used by the musical tone producing unit 20 to generate musical signal data, and impulse response data used in the resonance tone adding circuit 26. A waveform data storing unit 30 and impulse response data storing unit 31 are provided in ROM 16, as will be described later. RAM 18 serves to temporality store data generated in the course of running the program, variables, and parameters.

A damper pedal 24 is capable of outputting not only signals indicating ON and OFF positions of the damper pedal 24 but also a signal indicating an intermediate position of the damper pedal 24. In the present embodiment, for instance, in the vicinity of the damper pedal 24 there are provided two switches (first and second switches, not shown) are provided in a vertical direction (perpendicular to an axis of rotation of the damper pedal 24). When the damper pedal 24 is not pressed down, both the first and the second switches remain off. When the damper pedal 24 is pressed down half way, only the first switch is turned on and the second switch still remains off. When the damper pedal 24 is pressed down full way, both the first and the second switches are turned on. With the present arrangement of the damper pedal 24, there can be established three states of the damper pedal 24, that is, a full pedal state, in which the damper pedal 24 has been pressed down full way (both the switches are turned on), a half pedal state, in which the damper pedal 24 has been pressed down half way (only the first switch is turned on and the second switch remains off), and an off pedal state, in which the damper pedal 24 has not been pressed down (both the switches remain off).

In place of the above arrangement of the damper pedal and switches, a variable register may be used, which varies its resistance value in proportion to a pressing down level of the damper pedal 24 and outputs a signal corresponding to the resistance value.

Figure 2:
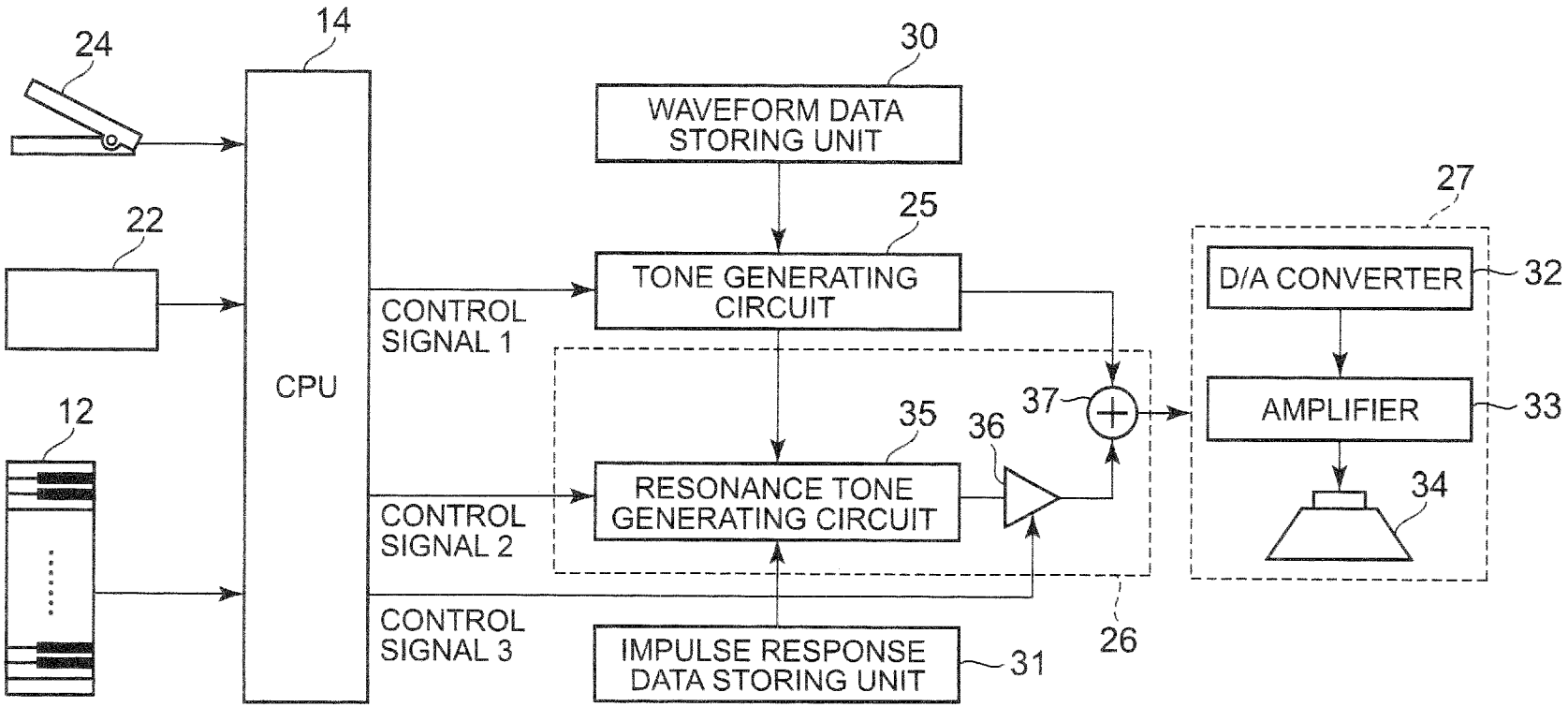
FIG. 2 is a block diagram illustrating a circuit configuration including a tone generating circuit, resonance tone adding circuit, acoustic system, and other elements connected thereto in the first embodiment of the invention.

FIG. 2 is a block diagram illustrating a circuit configuration including the tone generating circuit 25, resonance tone adding circuit 26, acoustic system 27, and other elements connected thereto. Receiving a control signal 1 from CPU 14, the tone generating circuit 25 reads waveform data from the waveform data storing unit 30 and outputs musical signal data of a certain timbre and pitch as shown in FIGS. 1 and 2, wherein the control signal 1 includes timbre information indicating a timbre of a musical tone to be generated, pitch information indicating a pitch of the musical tone, and velocity information.

Figure 3:
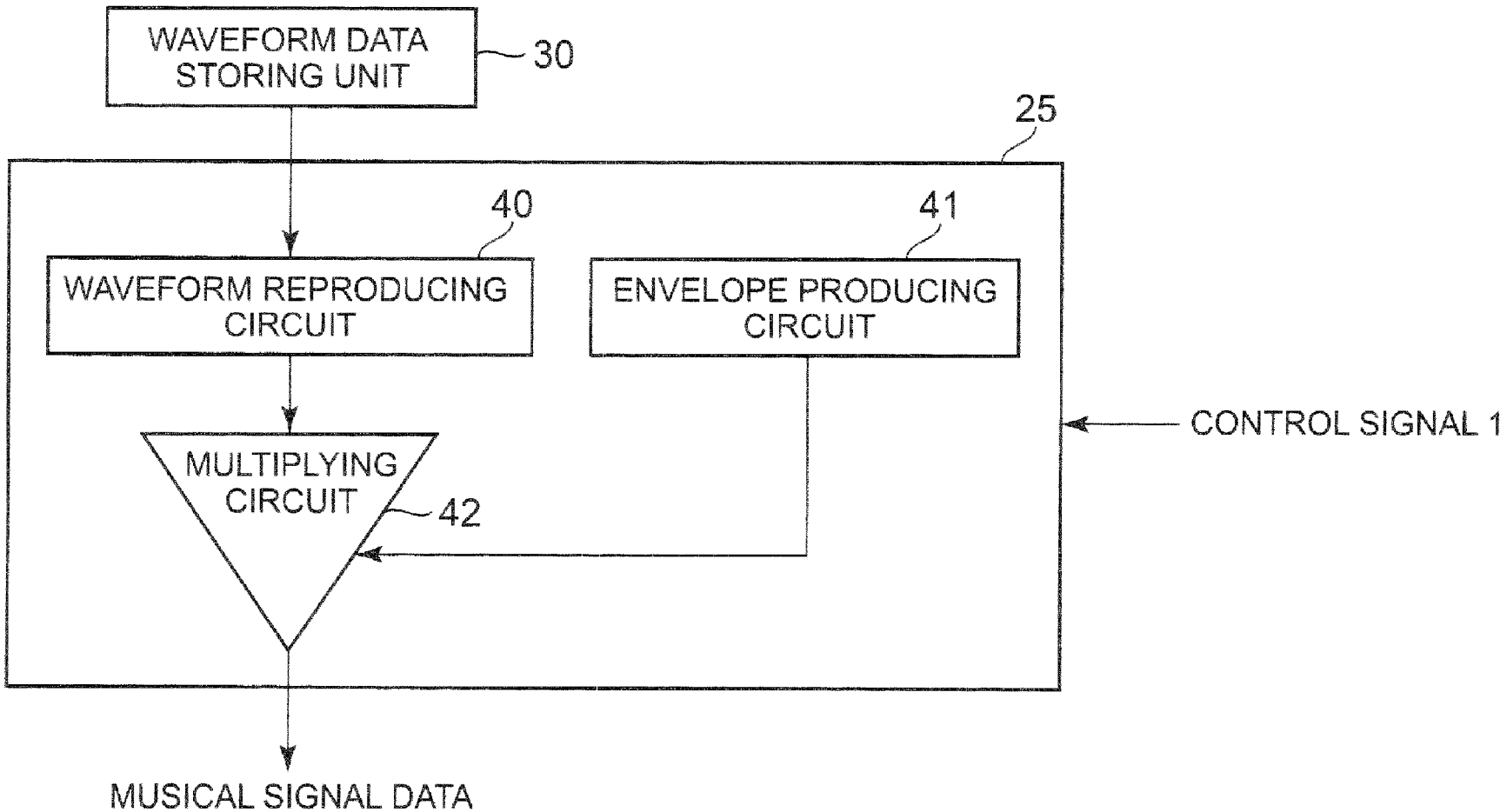
FIG. 3 is a block diagram illustrating the tone generating circuit 25 and other elements connected thereto in more detail.

FIG. 3 is a block diagram illustrating the tone generating circuit 25 and other elements connected thereto in detail. As shown in FIG. 3, the tone generating circuit 25 in the present embodiment comprises a wave form reproducing circuit 40, envelope producing circuit 41 and multiplying circuit 42. In the waveform data storing unit 30 are stored waveform data of various musical tones such as tones of a piano, violin, guitar, etc In accordance with the pitch information included in the control signal 1, the waveform reproducing circuit 40 reads waveform data corresponding to the timbre information included in the control signal 1 from among plural pieces of waveform data stored in the waveform data storing unit 30. The envelope producing circuit 41 outputs envelope data corresponding to the velocity information included in the control signal 1. The multiplying circuit 42 multiplies the waveform data by the envelope data, thereby outputting musical signal data. The musical signal data output from the tone generating circuit 25 is data including not only a single sort of data produced when a single key is pressed, but also plural sorts of data produced when plural keys are pressed respectively, wherein composite data is output.

The pitch information and envelope information included in the control signal 1 are produced by CPU 14 based on the signal sent from the keyboard 12. The timbre information included in the control signal 1 is produced by CPU 14 based on information corresponding to the operator of the operator group 22 operated by the player.

As shown in FIG. 2, the resonance tone adding circuit 26 comprises a resonance tone generating circuit 35, multiplying circuit 36 and adder circuit 37. The resonance tone generating circuit 35 comprises FIR filter with a feed back circuit as will be described later. The resonance tone generating circuit 35 performs a convolution operation based on musical signal data and impulse response data to produce resonance tone data, wherein the impulse response data includes plural impulse response coefficients and is read from the impulse response data storing unit 31. A level of the produced resonance tone data is adjusted in accordance with a control signal 3 in the multiplying circuit 36. The level adjusted resonance tone data and musical signal data are added together in the adder circuit 37, whereby composite data is generated.

The acoustic system 27 comprises D/A converter 32, amplifier 33 and speaker 34. The composite data output from the adder circuit is converted into an analog signal, and then the analog signal is amplified by the amplifier 33, and output from the speaker 34.

Figure 4:
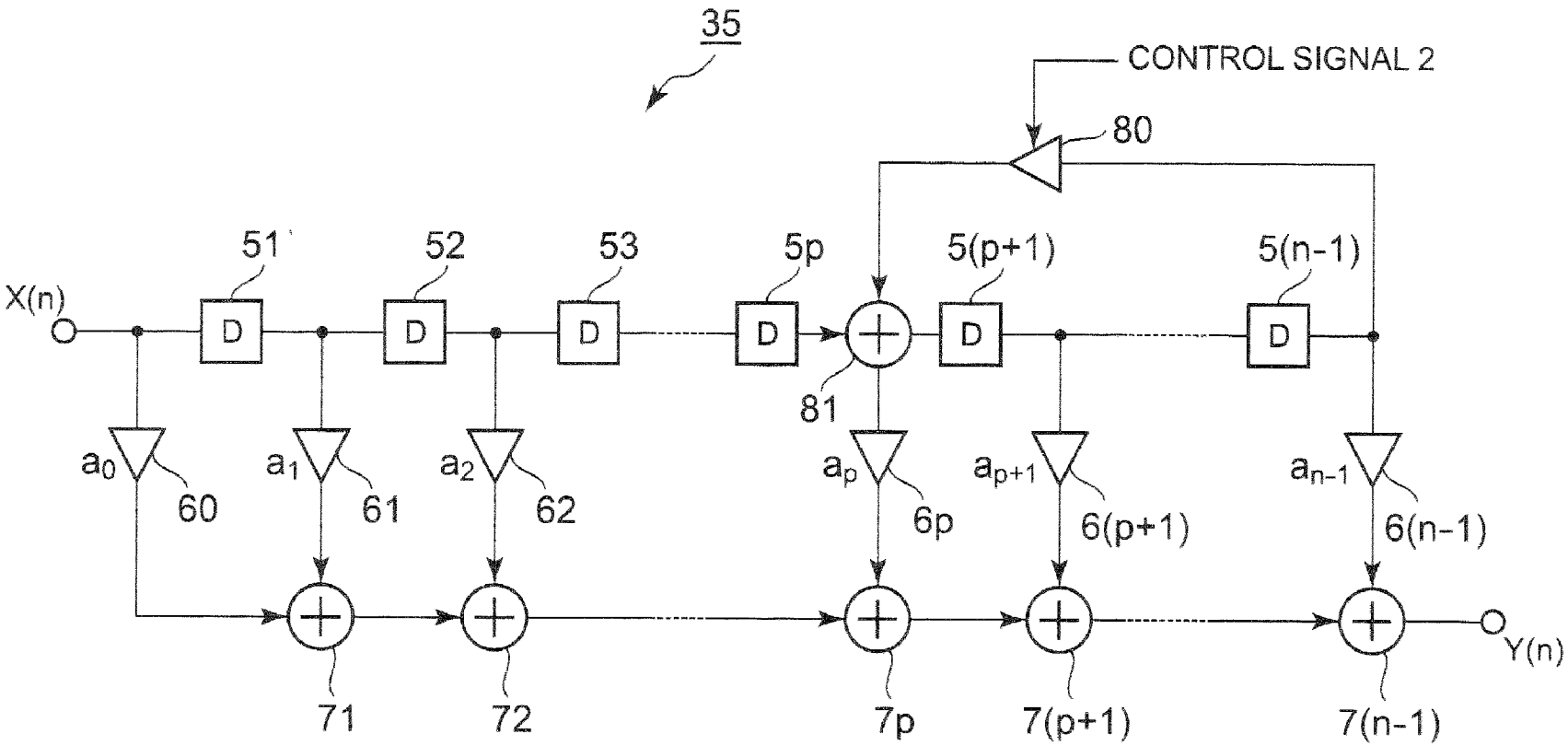
FIG. 4 is a block diagram briefly illustrating a resonance tone generating circuit in the first embodiment.

FIG. 4 is a block diagram briefly illustrating the resonance tone generating circuit 35 in the present embodiment. As shown in FIG. 4, the resonance tone generating circuit 35 in the present embodiment comprises plural delay circuits 51-5($n$−1), multiplying circuits 60-6($n$−1), adder circuits 71-7($n$−1), a multiplying circuit 80 and an adder circuit 81 provided between the delay circuit 5$p$ at the "p"th stage and the delay circuit 5($p$+1) at the (p+1)th stage, wherein the delay circuits 51-5($n$−1) serve to delay the musical signal data, and the multiplying circuits 60-6($n$−1) multiply the musical signal data or delayed musical signal data by the impulse response coefficients $a_0$-$a_{n-1}$, and the adder circuits 71-7($n$−1) successively sum up the output data of the multiplying circuits, and the multiplying circuit 80 receives output data from the delay circuit 5($n$−1) provided at the final stage ((n−1)th stage) and multiplies the same data by a multiplication coefficient included in the control signal 2, thereby generating multiplication data, and the adder circuit 81 sums up the delayed musical signal data output from the delay circuit 5$p$ and the multiplication data output from the multiplying circuit 80.

In the resonance tone generating circuit 35 in the present embodiment, input musical signal data X(n) is successively delayed by the delay circuits 51, 52, . . . , and 5($n$−1). The multiplying circuits 60, 61, 62, . . . , 6$p$, 6($p$+1), . . . , and 6($n$−1) are given the impulse response coefficients $a_0$, $a_1$, $a_2$, . . . , $a_p$, $a_{p+1}$, . . . , and $a_{n-1}$, respectively. In the multiplying circuits 60, 61, 62, . . . , 6$p$, 6($p$+1), . . . , and 6($n$−1), the musical signal data or delayed musical signal data is multiplied by appropriate impulse response coefficients, whereby plural pieces of multiplication data are obtained.

The multiplication results (the plural pieces of multiplication data) obtained by the multiplying circuits 60, 61, 62, . . . , and 6($n$−1) are accumulated in the adder circuits 71-7($n$−1). The accumulated data is output as resonance tone data Y(n). The delay circuits 51-5($n$−1), multiplying circuits 60-6($n$−1) and adder circuits 71-7($n$−1) compose FIR filter of "In" taps.

Further, in the present embodiment, the multiplying circuit 80 multiplies the musical signal data delayed and output from the delay circuit 5($n$−1) by the multiplication coefficient included in the control signal 2, thereby producing feed back waveform data whose level has been properly adjusted. The feed back waveform data, is supplied to the adder circuit 81 provided between the delay circuit 5$p$ at the "p"th stage and delay circuit 5($p$+1) at the (p+1)th stage. Therefore, in the adder circuit 81, the delayed musical signal data and feed back waveform data are added together and output to the delay circuit 5($p$+1) at the (p+1)th stage. In the multiplying circuits 6($p$+1), 6($p$+2), . . . , and 6($n$−1) at the (P+1)th and subsequent stages, the delayed musical signal data with feed back waveform added is multiplied by the appropriate impulse response coefficients respectively.

As shown in FIG. 4, the resonance tone generating circuit 35 in the present embodiment composes FIR filter of "n" taps provided with the feed back circuit including the multiplying circuit 80 and adder circuit 81. The delay circuits 51-5($n$−1), multiplying circuits 60-6($n$−1) and adder circuits 71-7($n$−1) in the resonance tone generating circuit 35 compose a convolution operation circuit, and the multiplying circuit 80 and adder circuit 81 compose the feed back circuit. For instance, FIR filter of "n" taps with no feed back circuit can produce a resonance tone of 1.8 sec. In the present embodiment, waveform data of piano tones of 1.8 sec. is stored as waveform data of the longest period in the waveform data storing unit 30. Therefore, to produce the above waveform data, an impulse response coefficient of "n" taps (1.8 sec.) is stored as impulse response data in the impulse response data storing unit 31. In the case no feed back waveform is supplied through the feed back circuit, the musical signal data and resonance tone data are combined during the period of 1.8 sec. from the time of tone generation and the combined data is output.

In the combined data of the musical signal data and resonance tone data are included string sounds, chamber sounds and string resonance tones included in the original waveform data, and in the resonance tone data are included reproduced string tones and string resonance tones. However, in actual piano sounds, a string resonance tone keeps sounding though in an extremely low level for more than 10 seconds, sometimes for several 10 seconds. Therefore, sometimes, reproduction of resonance tone for about 1.8 seconds is not enough.

Figure 5:
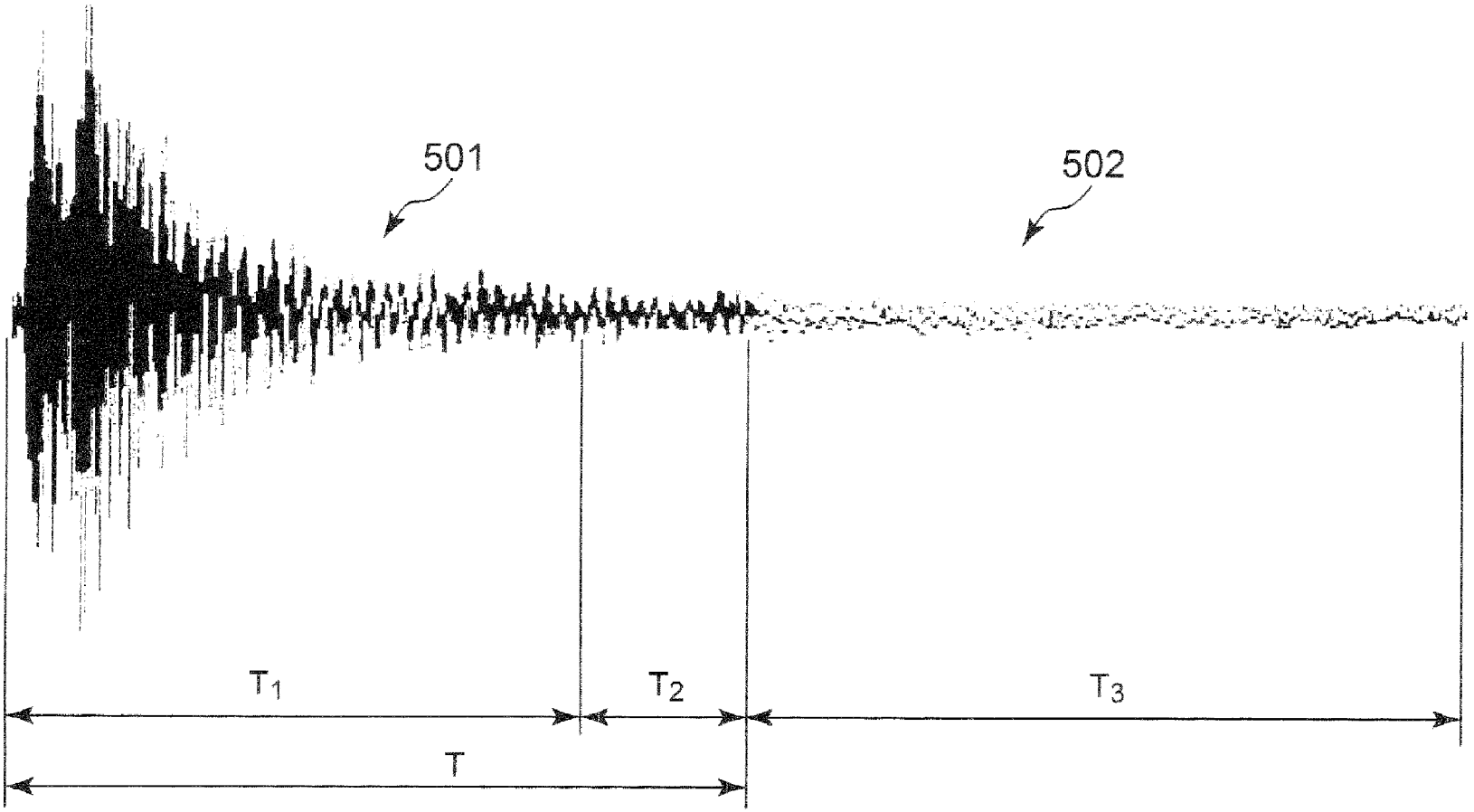
FIG. 5 is a view showing an example of the musical signal data and resonance tone data produced by the resonance tone generating circuit in the present embodiment.

FIG. 5 is a view showing an example of the musical signal data and resonance tone data produced in the present embodiment. In FIG. 5, a time "T" corresponds to a time duration (=1.8 sec.) of musical signal data of the piano waveform. In the piano waveform, a musical sound consists largely of chamber sounds and string resonance tones in the first time duration "$T_1$" (=about 1.6 sec.), and consists largely of string resonance tones in the remaining time duration "$T_2$" (=about 0.2 sec.). In the present embodiment, the musical signal data is fed back only during a time period of 0.2 sec. which corresponds to the time duration "$T_2$" shown in FIG. 5. In short, the number of taps from the (p+1)th stage to the (n−1)th stage corresponds to a time duration of 0.2 sec. Therefore, the fed back waveform data (feed back waveform data) is added to the musical signal data, and the multiplying circuits of the stages following the (p+1)th stage uses the impulse response coefficients to execute the convolution operation on the data (musical signal data with the feed back waveform data added), and thereafter repeatedly executes the convolution operation.

In FIG. 5, a waveform (Refer to a reference numeral 502) acquired by executing the convolution operation on data (musical signal data with the feed back waveform data added) during the time duration "$T_3$" is added to the waveform (Refer to a reference numeral 501) produced during the first time duration "T". The time duration "$T_3$" and a level of the waveform 502 are adjusted based on the control signal 2.

In the electronic musical instrument according to the present embodiment, in response to operation of a key of the key board 12, CPU 14 generates the control signal 1 to produce a musical tone of a pitch corresponding to the pressed key and sends the control signal 1 to the tone generating circuit 25, thereby instructing to generate a sound. In the tone generating circuit 25 (FIG. 3), in accordance with the pitch information included in the control signal 1 the waveform reproducing circuit 40 reads waveform data corresponding to timbre information included control signal 1 from among plural pieces of waveform data stored in the waveform data storing unit 30. The envelope producing circuit 41 outputs envelope data corresponding to the velocity information included in the control signal 1. The multiplying circuit 42 multiplies the waveform data by the envelope data, thereby outputting musical signal data.

As described above, there are established three states of the damper pedal 24, that is, the full pedal state, half pedal state, and the off pedal state. CPU 14 detects the state of the damper pedal 24, and generates the control signals 1 corresponding to the full pedal state, half pedal state, and off pedal state of the damper pedal 24, respectively. Further, in the present embodiment, CPU 14 calculates based on the state of the damper pedal 24 the multiplication coefficient to be included in the control signal 2, and supplies the control signal 2 to the multiplying circuit 80 of the resonance tone generating circuit 35.

Figure 6:
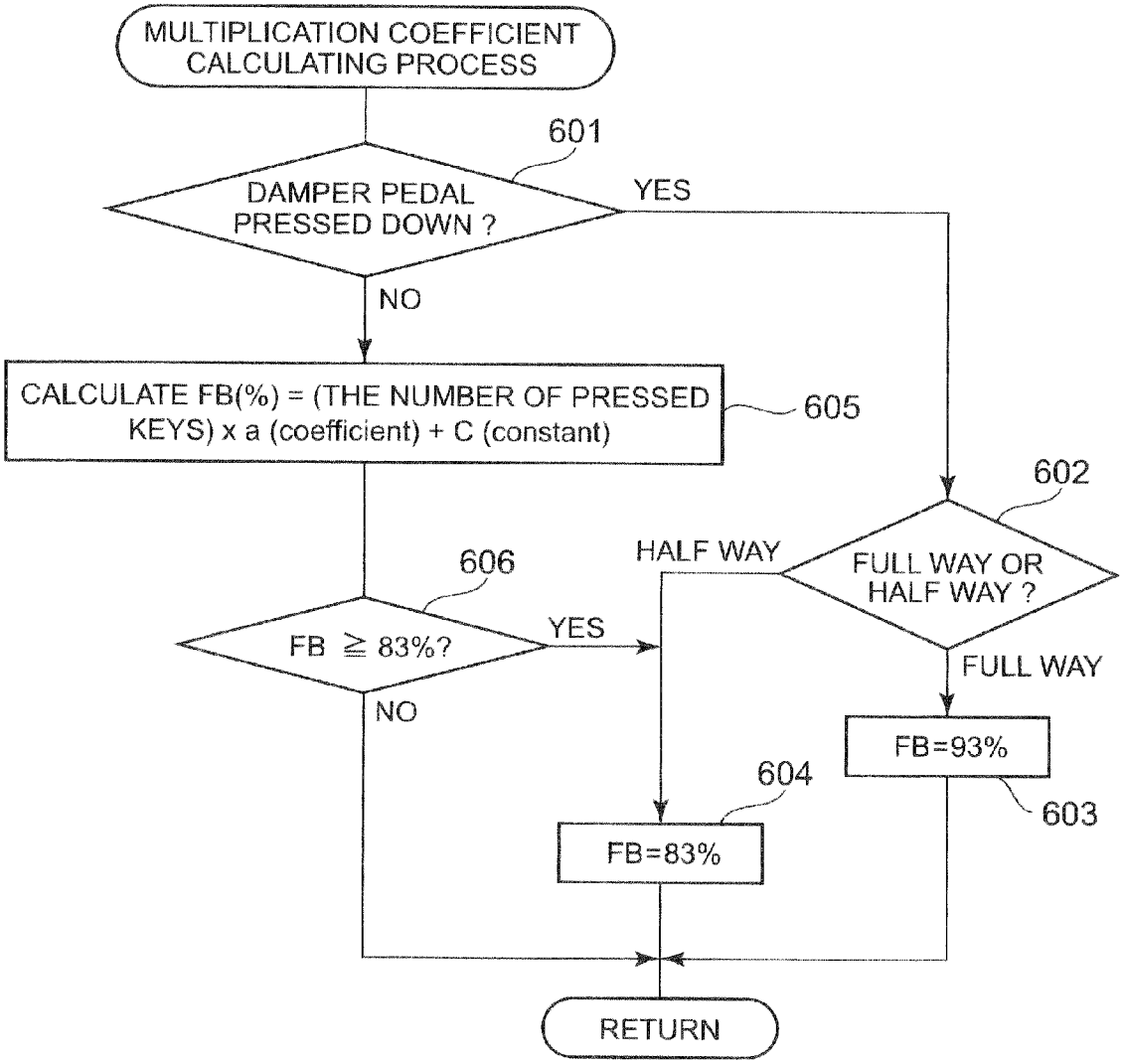
FIG. 6 is a flow chart of a multiplication coefficient calculating process for calculating a multiplication coefficient to be included in a control signal 2.

FIG. 6 is a flow chart of a multiplication coefficient calculating process for calculating a multiplication coefficient to be included in the control signal 2. In FIG. 6, the multiplication coefficient calculating process is performed when CPU 14 detects that a key of the key board 12 has been pressed down and generates the control signal 1 to be supplied to the tone generating circuit 25. As shown in FIG. 6, CPU 14 judges at step 601 whether or not the damper pedal 24 has been pressed down. When it is determined at step 601 that the damper pedal 24 has been pressed down (YES at step 601), CPU 14 judges at step 602 whether the damper pedal 24 has been pressed down full way or half way. When it is determined at step 602 that the damper pedal 24 has been pressed down full way, CPU 14 sets the multiplication coefficient FB to 93% (FB=93%) at step 603. The multiplication coefficient FB is included in the control signal 2. The control signal 2 is supplied to the multiplying circuit 80, and stored on a certain area of RAM 18. When it is determined at step 602 that the damper pedal 24 has been pressed down half way, CPU 14 sets the multiplication coefficient FB to 83% (FB=83%) at step 604. The multiplication coefficient is set to a value less than 100% to suppress parasitic oscillations when the damper pedal 24 has been pressed down full way or half way.

Meanwhile, when it is determined at step 601 that the damper pedal 24 has not been pressed down (NO at step 601), CPU 14 calculates at step 605 FB (%)=(the number of pressed keys)×a (coefficient)+C (constant), where, for instance, "a"=8 and "C"=30. Then, CPU 14 judges at step 606 whether the calculated FB is not less than 83% or not. When it is determined that the calculated FE is not less than 83% (YES at step 606), CPU 14 sets the multiplication coefficient FB to 83% (FB=83%) at step 604. When the damper pedal 24 has not been pressed down, only a string resonance tone is generated in principle. Therefore, a reverberation sound is reproduced, which has substantially the same level and reverberation time as the resonance tone generated when the damper pedal 24 has been pressed down half way.

In the present embodiment, in the case the damper pedal 24 is not pressed down, a level of the feed back waveform data, that is, the multiplication coefficient for specifying a mount to be fed back is changed based on the number of pressed keys, and the multiplication coefficient increases as the number of pressed keys increases before the feed back waveform data reaches a certain level, whereby such a state is realized that the more keys are pressed, the larger or longer become the level and reverberation time of reverberation sound.

When the damper pedal 24 has been pressed down, a multiplication coefficient of a certain level is acquired depending on the state of the damper pedal 24, because not only string resonance tones of pressed keys but also string resonance tones of other keys are generated when the damper pedal 24 is pressed down. Further, the multiplication coefficient in the full pedal state is set larger than in the half pedal state, whereby the level and reverberation time of reverberation sound corresponding to the state of damper pedal 24 can be reproduced.

The multiplication coefficient calculated as described above is supplied to the multiplying circuit 80 of the resonance tone generating circuit 35. Then, in the multiplying circuit 80, the waveform data output from the delay circuit 5($n$−1) at the final stage (the (n−1)th stage) of the FIR filter with "n" taps is multiplied by the calculated multiplication coefficient, and fed back to the adder circuit 81 as feed back waveform data not more than a value of "1". Then, the musical signal data output from the adder circuit 81 is successively delayed by the delay circuits 5($p$+1) . . . at the (p+1)th stage and successive stages, and subjected to the convolution operation with the impulse response coefficients in the multiplying circuits 6$p$, 6($p$+1), . . . at the "p"th and subsequent stages, and the data output from the multiplying circuits is accumulated by the adder circuits 71, 72, 7$p$, . . . , and output as resonance tone data Y(n).

The level of the resonance tone data Y(n) is adjusted based on a control signal 3 in the resonance tone generating circuit 35 and supplied to the adder circuit 37 (FIG. 2). The adder circuit 37 (in FIG. 2) sums up the resonance tone data and the musical signal data output from the tone generating circuit 25 and supplies the summed up data to the acoustic system 27 (FIG. 2).

Since the level of the feed back waveform decreases gradually, the level of the resonance tone data Y(n) gradually decreases finally to approximately "0". During a time duration before the level of the resonance tone data Y(n) decreases to approximately "0", the level of the feed back waveform changes in accordance with the multiplication coefficient FB. In the present embodiment, the waveform data is repeatedly multiplied by the impulse response coefficients corresponding to the final time duration T2 (FIG. 5), while the impulse response coefficients are decreasing by values corresponding to the multiplication coefficient.

In the present embodiment, first delayed data output from a product-sum operation circuit (delayed data output from the final stage) is multiplied by a certain multiplication coefficient, whereby multiplication data is obtained, and the multiplication data and second delayed data output from the product-sum operation circuit (delayed data output from the "p"th stage) are summed up and output. In this way, musical signal data of a certain level is fed back, and the fed back musical signal data and the delayed musical signal data are summed up and a product-sum operation is executed on the summed up musical signal data (waveform data), whereby a natural resonance tone can be reproduced over a time period longer than a reproducing time of the musical signal data.

More specifically, in the present embodiment, the musical signal data is successively delayed by the delay circuits 51, 52, . . . , 5($n$−1) respectively at the first to the (n−1)th stage in the product-sum circuit. The multiplying circuit 80 in the feed back circuit receives the delayed musical signal data from the delay circuit 5($n$−1) at the (n−1)th stage and multiplies the received data by the multiplication coefficient, thereby obtaining multiplication data. The adder circuit 81 in the feedback circuit sums up the delayed musical signal data and the multiplication data, wherein said delayed musical signal data is output from the delay circuit 5$p$ at the "p"th stage in the product-sum operation circuit and said multiplication data is supplied from the multiplying circuit 80. Then, the summed up data is supplied to the multiplying circuit 6$p$ at the "p"th stage and to the delay circuit 5($p$+1) at the (p+1) th stage. By setting a value of "p" to a desired value, a time duration of the musical signal data to be fed back can be adjusted.

In the present embodiment, when the damper pedal 24 is pressed down, there are established two pedal states, that is, the full pedal state and the half pedal state. The multiplication coefficient to be supplied to the multiplying circuit 80 in the feed back circuit is adjusted and set to a larger value when the damper pedal 24 is in the full pedal state than in the half pedal state. In other words, when the damper pedal 24 is in the full pedal state, a resonance tone having a higher level and a longer resonance time is generated than in the half pedal state. With the above arrangement of the damper pedal 24, the resonance tone can be reproduced in accordance with actual performance of the keyboard instrument.

In the present embodiment, when the damper pedal 24 is in the off pedal state (the damper pedal is not pressed down), the multiplication coefficient to be given to the multiplying circuit 80 in the feed back circuit is adjusted to increase as more keys of the key board 12 are pressed. With the arrangement, the resonance tone increases its level and resonance time as more keys of the keyboard 12 are pressed, and further the resonance tone can be reproduced in accordance with actual performance of the keyboard instrument.

Figure 7:
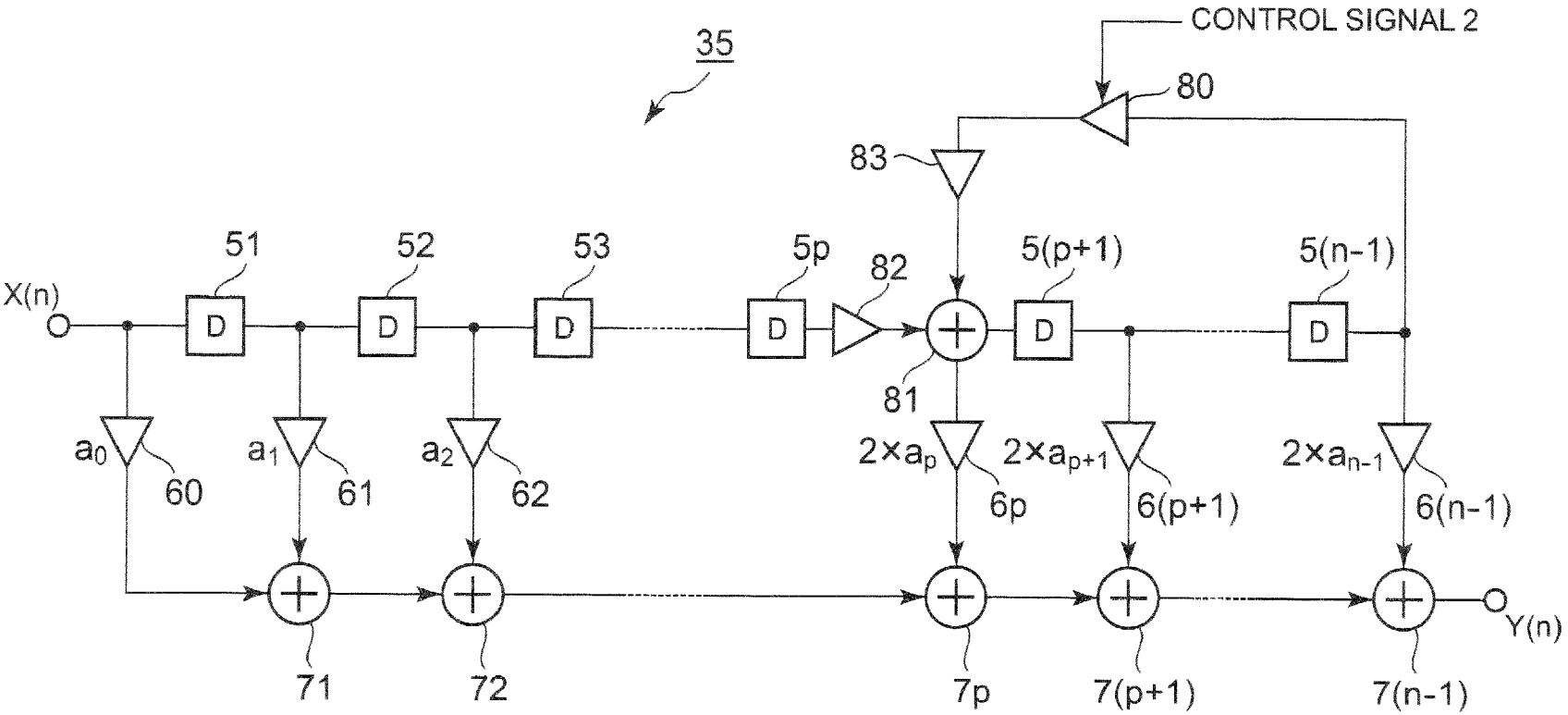
FIG. 7 is a block diagram of a circuit configuration of the resonance tone generating circuit in the second embodiment.

Now, the second embodiment of the invention will be described. In the second embodiment, the resonance tone generating circuit is provided with multiplying circuits for adjusting level of data input thereto, thereby preventing overflow of data caused due to summed up data of the delayed musical signal data and feed back waveform data. An electronic musical instrument according to the second embodiment of the invention has substantially the same circuit configuration as the first embodiment shown in FIG. 1. FIG. 7 is a block diagram of the resonance tone generating circuit in the second embodiment. In FIG. 7, like elements as those in the resonance tone generating circuit 35 in the first embodiment of FIG. 4 are designated by like reference numerals.

As shown in FIG. 7, the resonance tone generating circuit in the second embodiment of the invention is provided with multiplying circuits 82, 83, wherein the multiplying circuit 83 decreases multiplication data supplied from the multiplying circuit 80 to "½" and also the multiplying circuits 82 decreases the musical signal data supplied from the delay circuit 5$p$ at the "p"th stage to "½". As described above, the multiplying circuit 80 multiplies the musical signal data supplied from the delay circuit 5($n$−1) at the (n−1)th stage by the multiplication coefficient included in the control signal 2, thereby obtaining the multiplication data (feed back waveform data). The multiplying circuits 6$p$, 6($p$+1), . . . , and 6($n$−1) respectively at the "p"th, (p+1)th, . . . , and (n−1)th stage for executing the convolution operation are arranged to multiply the delayed musical signal data by appropriate double-impulse response coefficients ($2xa_p$, $2xa_{(p+1)}$, . . . , and $2xa_{(n-1)}$), respectively.

In the second embodiment, the level of the feed back waveform data output from the multiplying circuit 80 is decreased to ½ and also the level of the musical signal data output from the delay circuit 5$p$ is decreased to ½. These feed back waveform data and the musical signal data, whose levels have been decreased to ½ are summed up, whereby data overflow is prevented. Meanwhile, the impulse response coefficients to be applied to the multiplying circuits 6$p$-6($n$−1) at the "p"th to (n−1)th stage are doubled, whereby the doubled multiplication coefficients compensate the musical signal data whose level has been decreased to ½.

In the second embodiment, the multiplication coefficients to be set to the multiplying circuits 82 and 83 in the feed back circuit and the multiplication coefficients to be set to the multiplying circuits 6$p$, 6($p$+1), . . . , and 6($n$−1) in the product-sum circuit are adjusted by CPU 14. In the second embodiment, the multiplication coefficients of the multiplying circuits 82 and 83 are set to ½, and the multiplication coefficients of the multiplying circuits 6$p$, 6($p$+1), . . . , and 6($n$−1) are set to values equivalent to the doubled impulse response coefficients, respectively. But it may be possible to set the former multiplication coefficients to "a" ("a"<1), and the latter multiplication coefficients to "1/a" of the impulse response coefficients.

In the second embodiment, a level of data to be supplied from the multiplying circuit 80 to the adder circuit 81 in the feed back circuit is adjusted, and also a level of data to be supplied from the adder circuit 5$p$ at the "p"th stage to the adder circuit 81 is adjusted. When the data levels are adjusted, the impulse response coefficients to be set to the multiplying circuits 6$p$ to 6($n$−1) at the "p"th to (n−1)th stage are also adjusted in accordance with the adjustment of data level. As a result, data overflow is prevented in the adder circuit 81 and output levels of the convolution operation executed at the "p"th and subsequent stages are appropriately adjusted. Therefore, a natural resonance tone having a proper level can be reproduced.

Figure 8:
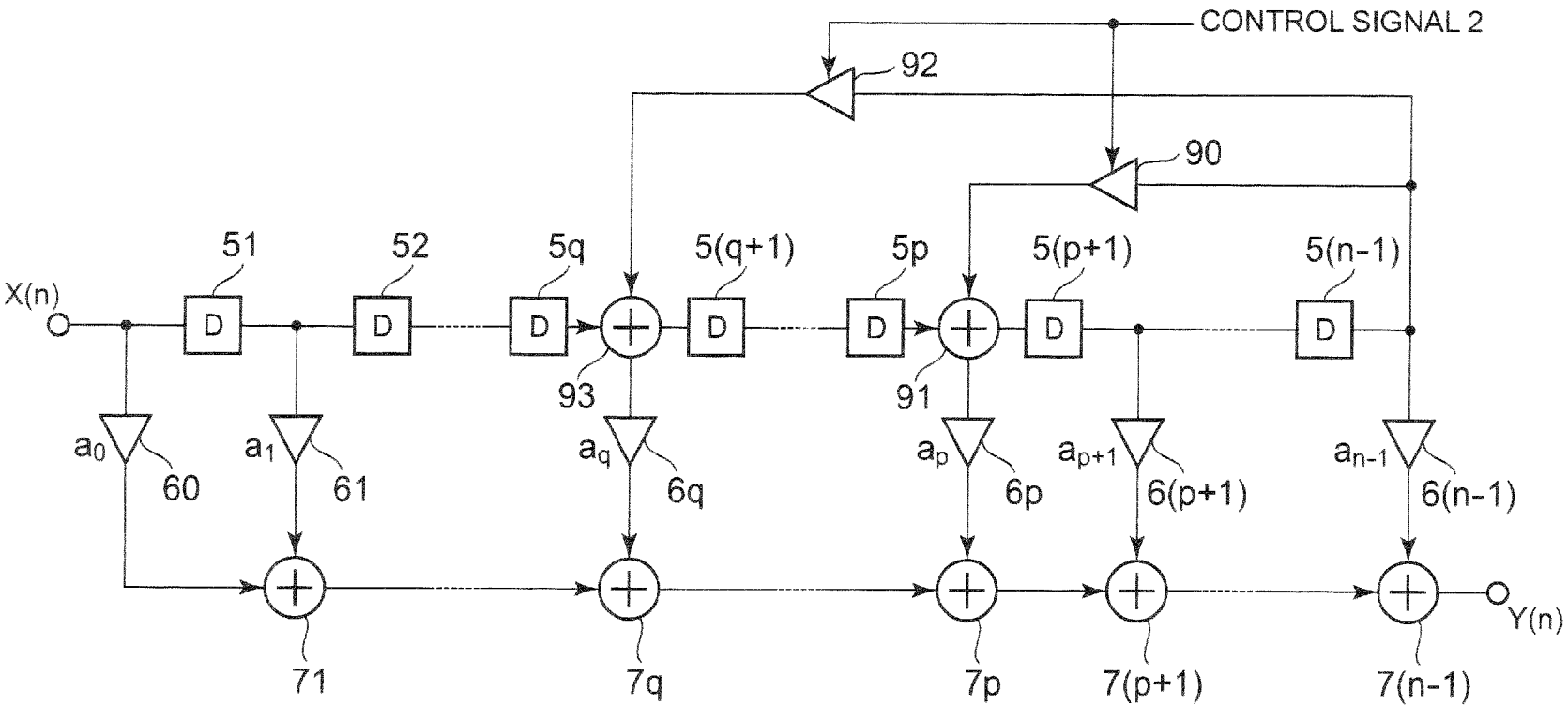
FIG. 8 is a block diagram of a circuit configuration of the resonance tone generating circuit in the third embodiment.

Now, the third embodiment of the present invention will be described. In the third embodiment, feed back waveform data is fed backed to a point between the delay circuit 5$p$ at the "p"th stage and the delay circuit 5($p$+1) at the (p+1)th stage and further feed back waveform data is fed backed to a point between the delay circuit 5$q$ at the "q"th stage (q<p) and the delay circuit 5($q$+1) at the (q+1)th stage. An electronic musical instrument according to the third embodiment of the invention has substantially the same circuit configuration as the first embodiment shown in FIG. 1. FIG. 8 is a block diagram of the resonance tone generating circuit in the third embodiment. In FIG. 8, like elements as those in the resonance tone generating circuit 35 in the first embodiment of FIG. 4 are designated by like reference numerals.

As shown in FIG. 8, the resonance tone generating circuit in the third embodiment of the invention is provided with a multiplying circuit 90, adder circuit 91, multiplying circuit 92, and adder circuit 93, wherein the multiplying circuit 90 multiplies the musical signal data from the delay circuit 5($n$-1) at the (n−1)th stage by a first multiplication coefficient included in the control signal 2, and the adder circuit 91 is disposed between the delay circuit 5$p$ at the "p"th stage and the delay circuit 5($p$+1) at the (p+1)th stage and sums up delayed data supplied from the delay circuit 5$p$ and multiplication data from the multiplying circuit 90, and the multiplying circuit 92 multiplies the musical signal data from the delay circuit 5($n$−1) at the (n−1)th stage by a second multiplication coefficient included in the control signal 2, and the adder circuit 93 is disposed between the delay circuit 5$q$ at the "q"th stage and the delay circuit 5($q$+1) at the (q−1)th stage and sums up delayed data supplied from the delay circuit 5$q$ and multiplication data from the multiplying circuit 92.

The first and second multiplication coefficients are adjusted by CPU 14 such that, when one of the first and second multiplication coefficients is the multiplication coefficient FB which has been calculated in the multiplication coefficient calculating process of FIG. 6, the other multiplication coefficient is set to "0". In the third embodiment, for instance, values of "p" and "q" are set such that a resonance tone of 1.8 sec. is produced by FIR filter with "n" taps, and a resonance tone of 0.2 sec. is produced at the taps in a range between the (p+1)th stage and the (n−1)th stage, and a resonance tone of 0.4 sec. is produced at the taps in a range between the (q+1)th stage and the (n−1)th stage.

For example, in the case where the first multiplication coefficient is set to FB and the second multiplication coefficient is set to "0", the resonance tone generating circuit in the third embodiment shows substantially the same performance as FIR filter in the first embodiment. Meanwhile, in the case where the first multiplication coefficient is set to "0" and the second multiplication coefficient is set to FB, the musical tone data of a longer time duration (0.4 sec.) can be fed back.

Further, in the third embodiment, CPU 14 can calculate t×FB, where "t" is a constant between 0 to 1, thereby acquiring the first multiplication coefficient, and can calculate (1−t)×FB, thereby acquiring the second multiplication coefficient. The calculated multiplication coefficients are applied to the multiplying circuits 90, 91, respectively, whereby the musical signal data of 0.2 sec. and musical signal data of 0.4 sec. can be fed back at a desired rate.

In the third embodiment, the resonance Lone generating circuit is provided with two feed back circuits, through which two feed back waveform signals are fed back. The multiplying circuit in each feed back circuit can adjust the multiplication coefficients. Further, positions can be switched where the feed back waveform signals are applied to. By adjusting the multiplication coefficients, two feed back waveform signals can be applied through feed back passes, respectively.

Figure 9:
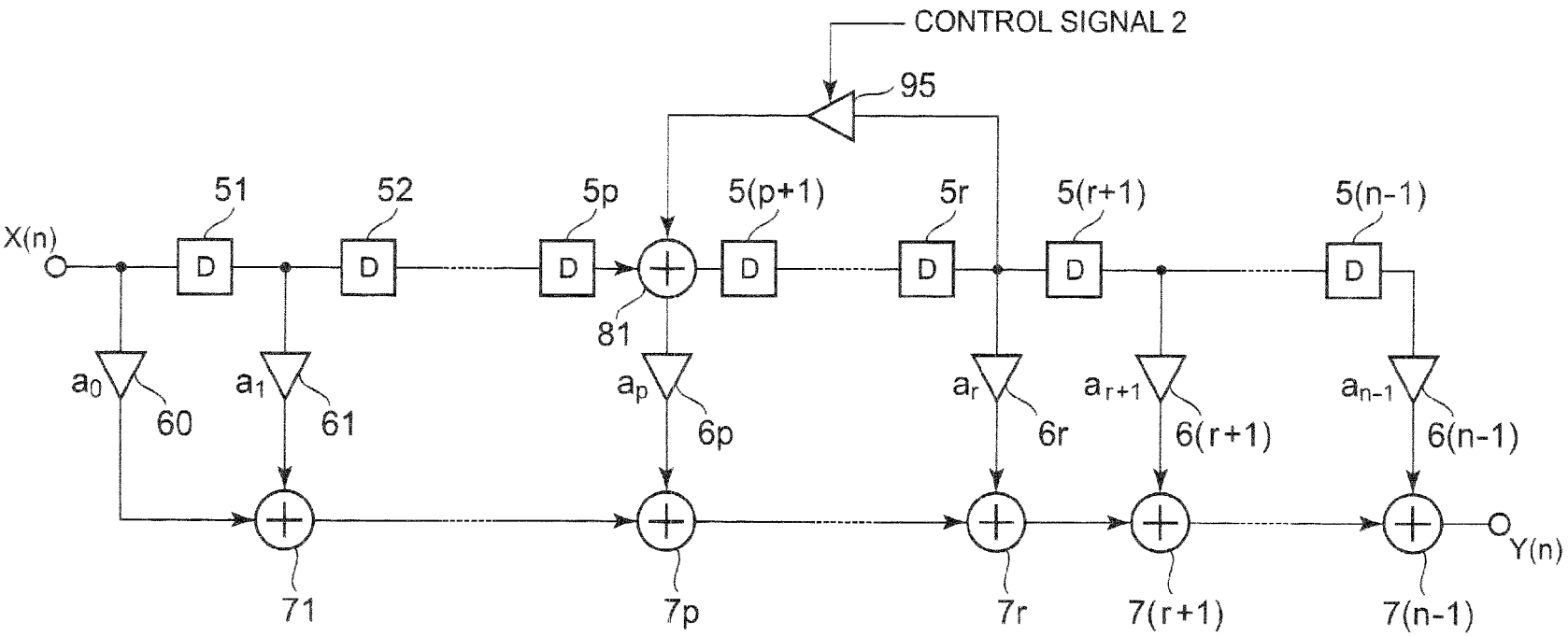
FIG. 9 is a block diagram of a circuit configuration of the resonance tone generating circuit in the fourth embodiment.

Now, the fourth embodiment of the invention will be described with reference to a circuit configuration shown in FIG. 9. In the first, second and third embodiments, data output from the delay circuit 5($n$−1) at the (n−1)th stage is supplied to the multiplying circuit, and the supplied data is multiplied by the multiplication coefficient in the multiplying circuit, whereby feed back waveform data is produced. But in the fourth embodiment, data output from the delay circuit 5$r$ at the "r"th stage (r<n−1) is fed back. In other words, in FIR filter with "n" taps, data output from an intermediate stage is fed back in place of the data output from the final stage (the (n−1) stage). An electronic musical instrument according to the fourth embodiment of the invention has substantially the same circuit configuration as the first embodiment shown in FIG. 1. FIG. 9 is a block diagram of the resonance tone generating circuit in the fourth embodiment. In FIG. 9, like elements as those in the resonance tone generating circuit 35 in the first embodiment of FIG. 4 are designated by like reference numerals.

As shown in FIG. 9, a resonance tone generating circuit in the fourth embodiment is provided with a feed back circuit including a multiplying circuit 95 and adder circuit 81, wherein the multiplying circuit 95 receives data from the delay circuit 5$r$ at the "r"th stage (r<n−1) and multiplies the received data by the multiplication coefficient included in the control signal 2, and the adder circuit 81 is disposed between the delay circuit 5$p$ at the "p"th stage (P<r) and the delay circuit 5($p$+1) at the (p+1)th stage and sums up the musical signal data output from the delay circuit 5$p$ and the feed back waveform data output from the multiplying circuit 95.

In the fourth embodiment, the musical signal data at the (r−P)th tap is fed back. In the case where a time duration of the musical signal data is shorter than a time duration at the "n" tap, when the musical signal data from the delay circuit 5($n$−1) at the (n−1)th stage is fed back, whereby feed back waveform data is generated, the result (data) of the convolution operation cab be a value other than "0" because of the feed back waveform data, raising the possibility of generating an unnatural reverberation sound, even if no delayed waveform data has been supplied. So, in the fourth embodiment, the "r"th stage is set such that when the musical signal data at the "r"th stage is fed back, a time duration of the musical signal data is made equivalent to or longer than the time duration at the "r"th tap, and data output from the delay circuit 5$r$ at the "r"th stage is fed back, whereby generation of an unnatural reverberation sound can be prevented.

The above embodiments of the invention are described only to illustrate preferred embodiments of the inventions, for better understanding of the principle and structure of the present invention, and by no means restrict the scope of the inventions defined in the accompanying claims. Therefore, it should be understood that various sorts of alternations and modifications may be made to the above embodiments of the invention and such alternations and modifications will fall within the scope of the invention In the above embodiments, it is described that FIR filter comprises the resonance tone generating circuit having (n−1) units of delay circuits (for instance, the delay circuits 51 to 5($n$−1) in FIG. 4), "n" units of multiplying circuits (multiplying circuits 60 to 6($n$−1) in FIG. 4), and (n−1) units of adder circuits (for instance, the adder circuits 71 to 7($n$−1) in FIG. 5). However, there is no need in practice to prepare (n−1) units of delay circuits, "n" units of multiplying circuits and (n−1) units of adder circuits for the resonance tone generating circuit. For instance, using a pipeline operation, the resonance tone generating circuit in the first embodiment can be made of a hardware configuration as shown in FIG. 10.

Figure 10:
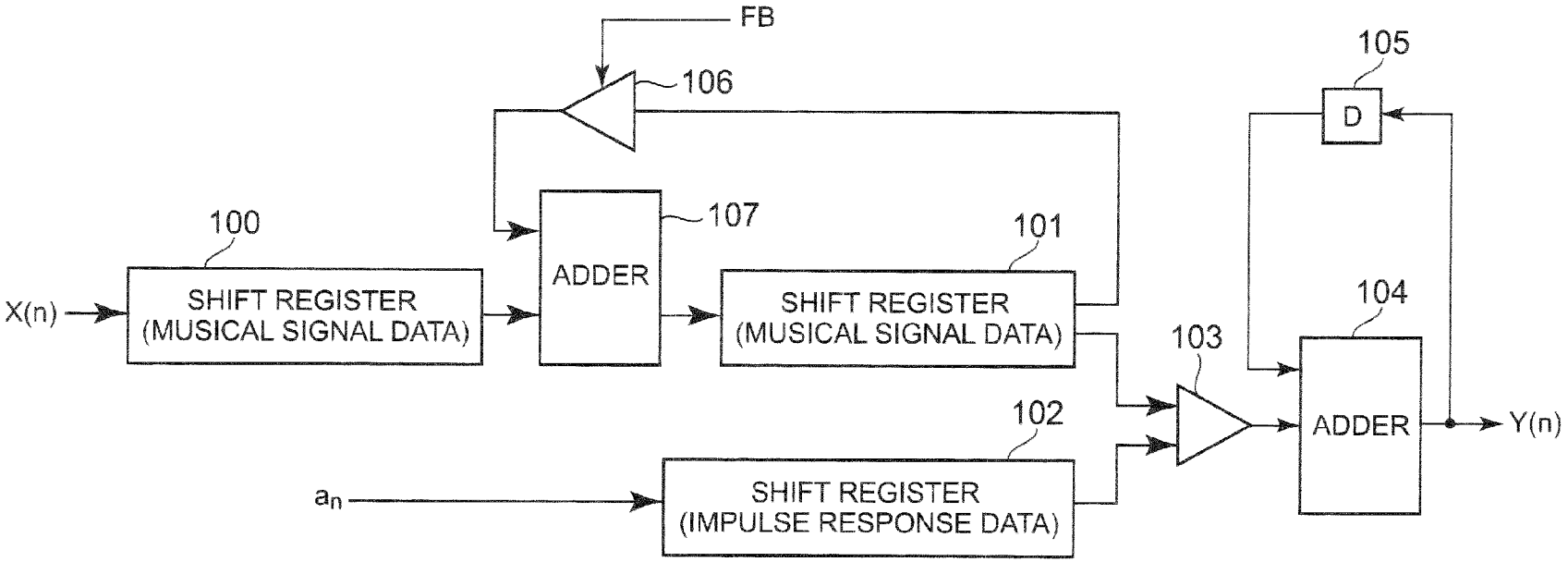
FIG. 10 is a view illustrating a hardware configuration of the resonance tone generating circuit of the first embodiment.

As shown in FIG. 10, the resonance tone generating circuit comprises two shift registers 100, 10, a shift register 102, a multiplying circuit 103, an adder circuit 104, and a delay circuit 105, wherein the shift registers 100, 11 serve to shift the musical signal, data and the shift register 102 serves to shift the impulse response data, and the multiplying circuit 103 multiplies the musical signal data by an impulse response coefficient included in the impulse response data. The shift register 100 is a shift registers of (n+1) stages and the shift register 101 is a shift register of (n−p+1) stages. A product-sum circuit consists of the shift registers 100, 101, shift register 102, multiplying circuit 103, adder circuit 104, and the delay circuit 105. The shift registers 100, 101 serve as delay circuits for delaying the musical signal data. The multiplying circuit 103 serves as a multiplying circuit for multiplying the musical signal data by the impulse response coefficient included in the impulse response data. The adder circuit 104 and delay circuit 105 serve as an adder circuit for summing up data.

As shown in FIG. 10, the resonance tone generating circuit further comprises a multiplying circuit 106 and adder circuit 107, wherein the multiplying circuit 106 multiplies data output from the shift register 101 by the multiplication coefficient FB, and adder circuit 107 sums up the musical signal data and multiplication data output from the multiplying circuit 106. The multiplying circuit 106 and adder circuit 107 work as a feed back circuit. Using the circuit configuration shown in FIG. 10, the product-sum circuit can be realized using the less number of hardware elements.

In the fourth embodiment, it may be possible to use two multiplying circuits in the resonance tone generating circuit as in the second embodiment, wherein one multiplying circuit adjusts an output level of the multiplying circuit 95 and the other multiplying circuit adjusts an output level of the delay circuit 5*p*, whereby output levels of the multiplying circuits 6*p* to 6(*n*−1) at the "p"th stage and subsequent stages are adjusted in accordance with the level adjustment made by the multiplying circuits. This modification may be made with respect to the third embodiment, too.

In the above embodiments of the invention, when the damper pedal 24 is pressed down, two pedal states are established, that is, the full pedal state and the half pedal state. When the damper pedal 24 is in the full pedal state, the multiplication coefficient to be applied to the multiplying circuit 80 in the feed back circuit is adjusted larger than in the half pedal state. However, a modification may be made to the embodiments, such that a variable resistor is used which varies its resistance depending on how much the damper pedal 24 is pressed down toward and a signal is produced whose level varies with the resistance value of the variable resistor, and in accordance with the signal level, the multiplication coefficient to be applied to the multiplying circuit 80 in the feed back circuit increases as the damper pedal 24 is pressed down.

What is claimed is:

1. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit, wherein the feed back unit comprises a multiplying unit for multiplying the first delayed musical signal data output from the product-sum operation unit by a multiplication coefficient to obtain multiplication data and an adder unit for summing up second delayed musical signal data output from the product-sum operation unit and the multiplication data obtained by the multiplying unit of the feed back unit;

wherein:

the product-sum operation unit has plural stages from the first stage to the (n−1)th stage, and delays the musical signal data in the delay units respectively at the plural stages;

the multiplying unit of the feed back unit receives the delayed musical signal data from the delay unit at the (n−1)th stage and multiplies the received musical signal data by the multiplication coefficient to obtain multiplication data;

the adder unit of the feed back unit sums up the delayed musical signal data output from the delay unit at the "p"th stage (p<n−1) and the multiplication data obtained by the multiplying unit of the feed back unit obtain summed up data, and supplies the summed up data to the multiplying unit at the "p"th stage in the product sum operation unit and to the delay unit at the (p+1)th stage in the product-sum operation unit;

the feed back unit further comprises a first level adjusting unit and a second level adjusting unit, wherein the first level adjusting unit adjusts a level of the multiplication data which is obtained by the multiplying unit of the feed back unit to be supplied to the adder unit of the feed back unit, and the second level adjusting unit adjusts a level of the delayed musical signal data which is output from the delay unit of the product-sum operation unit to be supplied to the adder unit of the feed back; and the product-sum operation unit has a coefficient adjusting unit for adjusting impulse response coefficients of the multiplying units at the "p"th and subsequent stages in the product-sum operation unit in accordance with level adjustment made by the first and second level adjusting units of the feed back unit.

2. The resonance tone generating apparatus according to claim 1, wherein the resonance tone generating apparatus is connected with an electronic musical instrument provided with a damper pedal; and wherein the resonance tone generating apparatus further comprises a multiplication coefficient controlling unit for controlling the multiplication coefficient of the multiplying unit in the feed back unit to increase as the damper pedal is pressed down toward the floor.

3. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit, wherein the feed back unit comprises a multiplying unit for multiplying the first delayed musical signal data output from the product-sum operation unit by a multiplication coefficient to obtain multiplication data and an adder unit for summing up second delayed musical signal data output from the product-sum operation unit and the multiplication data obtained by the multiplying unit of the feed back unit;

wherein the resonance tone generating apparatus is connected with an electronic musical instrument provided with a damper pedal; and wherein the resonance tone generating apparatus further comprises a multiplication coefficient controlling unit for controlling the multiplication coefficient of the multiplying unit in the feed back unit to increase as the damper pedal is pressed down toward the floor.

4. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit, wherein the feed back unit comprises a multiplying unit for multiplying the first delayed musical signal data output from the product-sum operation unit by a multiplication coefficient to obtain multiplication data and an adder unit for summing up second delayed musical signal data output from the product-sum operation unit and the multiplication data obtained by the multiplying unit of the feed back unit;

wherein the resonance tone generating apparatus is connected with an electronic musical instrument provided with a key board having plural keys; and wherein the resonance tone generating apparatus further comprises a multiplication coefficient controlling unit for controlling the multiplication coefficient of the multiplying unit in the feed back unit to increase as the more number of keys of the key board are pressed.

5. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit, wherein the feed back unit comprises a multiplying unit for multiplying the first delayed musical signal data output from the product-sum operation unit by a multiplication coefficient to obtain multiplication data and an adder unit for summing up second delayed musical signal data output from the product-sum operation unit and the multiplication data obtained by the multiplying unit of the feed back unit;

wherein the resonance tone generating apparatus is connected with an electronic musical instrument provided with a damper pedal and a key board having plural keys; and wherein the resonance tone generating apparatus further comprises a coefficient controlling unit for controlling (i) the multiplication coefficient of the multiplying unit in the feed back unit to increase as the damper pedal is pressed down toward the floor, and ii the multiplication coefficient of the multiplying unit in the feed back unit to increase as the more number of keys of the key board are pressed when the damper pedal is not pressed down.

6. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit, wherein the feed back unit comprises a multiplying unit for multiplying the first delayed musical signal data output from the product-sum operation unit by a multiplication coefficient to obtain multiplication data and an adder unit for summing up second delayed musical signal data output from the product-sum operation unit and the multiplication data obtained by the multiplying unit of the feed back unit;

wherein:

the product-sum operation unit has plural stages from the first stage to the (n−1)th stage, and delays the musical signal data in the delay units respectively at the plural stages;

the multiplying unit of the feed back unit receives the delayed musical signal data from the delay unit at the (n−1)th stage and multiplies the received musical signal data by the multiplication coefficient to obtain multiplication data;

the adder unit of the feed back unit sums up the delayed musical signal data output from the delay unit at the "p"th stage ($p<n-1$) and the multiplication data obtained by the multiplying unit of the feed back unit obtain summed up data, and supplies the summed up data to the multiplying unit at the "p"th stage in the product sum operation unit and to the delay unit at the (p+1)th stage in the product-sum operation unit;

the resonance tone generating apparatus is connected with an electronic musical instrument provided with a damper pedal; and the resonance tone generating apparatus further comprises a multiplication coefficient controlling unit for controlling the multiplication coefficient of the multiplying unit in the feed back unit to increase as the damper pedal is pressed down toward the floor.

7. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit;

wherein:

the product-sum operation unit has plural stages from the first stage to the (n−1)th stage, and delays the musical signal data in the delay units respectively at the plural stages;

the feed back unit comprises a first multiplying unit, a first adder unit, a second multiplying unit, and a second adder unit;

the first multiplying unit receives the delayed musical signal data from the delay unit at the (n−1)th stage and multiplies the received musical signal data by a first multiplication coefficient to obtain multiplication data;

the first adder unit sums up the delayed musical signal data output from the delay unit at a "p"th stage (p<n−1) in the product-sum operation unit and the multiplication data obtained by the first multiplying unit to obtain summed up data, and supplies the summed up data to the first multiplying unit at the "p"th stage in the product-sum operation unit and to the delay unit at the (p+1)th stage in the product-sum operation unit;

the second multiplying unit receives the delayed musical signal data from the delay unit at the (n−1)th stage in the product-sum operation unit and multiplies the received musical signal data by a second multiplication coefficient to obtain multiplication data;

the second adder unit sums up the delayed musical signal data output from the delay unit at a "q"th stage (q<p) in the product-sum operation unit and the multiplication data output from the second multiplying unit to obtain summed up data, and supplies the summed up data to the second multiplying unit at the "q"th stage in the product-sum operation unit and to the delay unit at the (q+1)th stage in the product-sum operation unit;

the resonance tone generating apparatus is connected with an electronic musical instrument provided with a damper pedal; and the resonance tone generating apparatus further comprises a multiplication coefficient controlling unit for controlling at least one of the first and second multiplication coefficients of the first and second multiplying units in the feed back unit to increase as the damper pedal is pressed down toward the floor.

8. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit, wherein the feed back unit comprises a multiplying unit for multiplying the first delayed musical signal data output from the product-sum operation unit by a multiplication coefficient to obtain multiplication data and an adder unit for summing up second delayed musical signal data output from the product-sum operation unit and the multiplication data obtained by the multiplying unit of the feed back unit;

wherein:

the product-sum operation unit has plural stages from the first stage to the (n−1)th stage, and delays the musical signal data in the delay units respectively at the plural stages;

the multiplying unit of the feed back unit receives the delayed musical signal data from the delay unit at a "r"th stage (r<n−1) in the product-sum operation unit and multiplies the received musical signal data by the multiplication coefficient to obtain multiplication data;

the adder unit of the feed back unit sums up the delayed musical signal data output from the delay unit at a "p"th stage (p<r) in the product-sun operation unit and the multiplication data obtained by the multiplying unit of the feed back unit to obtain summed up data, and supplies the summed up data to the multiplying unit at the "p"th stage in the product-sum operation unit and to the delay unit at the (p+1)th stage in the product-sum operation unit;

the resonance tone generating apparatus is connected with an electronic musical instrument provided with a damper pedal; and the resonance tone generating apparatus further comprises a multiplication coefficient controlling unit for controlling the multiplication coefficient of the multiplying unit in the feed back unit to increase as the damper pedal is pressed down toward the floor.

9. A resonance tone generating apparatus for generating resonance tone data to be applied to musical signal data, comprising:

an impulse response data storing unit for storing impulse response data including impulse response coefficients, wherein the impulse response coefficient indicates an impulse response characteristic and is defined by a value on a time axis;

a product-sum operation unit for performing a product-sum operation on a series of musical signal data on the time axis and the impulse response coefficients read from the impulse response data storing unit, wherein the product-sum operation unit comprises plural delay units for delaying the musical signal data, plural multiplying units for multiplying one of the musical signal data and delayed musical signal data output from the delay units by the impulse response coefficients, and plural adder units for summing up data output from the multiplying units; and a feed back unit for feeding back first delayed musical signal data output from the product-sum operation unit to the product-sum operation unit;

wherein:

the product-sum operation unit has plural stages from the first stage to the (n−1)th stage, and delays the musical signal data in the delay units respectively at the plural stages;

the feed back unit comprises a first multiplying unit, a first adder unit, a second multiplying unit, and a second adder unit;

the first multiplying unit receives the delayed musical signal data output from the delay unit at a "r" th stage (r<n−1) in the product-sum operation unit and multiplies the received musical signal data by a first multiplication coefficient to obtain multiplication data;

the first adder unit sums up the delayed musical signal data output from the delay unit a "p"th stage (p<r) in the product sum operation unit and the multiplication data obtained by the first multiplying unit to obtain summed up data, and supplies the summed up data to the first multiplying unit at the "p"th stage in the product-sum operation unit and to the delay unit at the (p+1)th stage in the product-sum operation unit;

the second multiplying unit receives the delayed musical signal data from the delay unit at the "r"th stage and multiplies the received musical signal data by a second multiplication coefficient to obtain multiplication data;

the second adder unit sums up the delayed musical signal data output from the delay unit at a "q"th stage (q<p) in the product-sum operation unit and the multiplication data obtained by the second multiplying unit to obtain summed up data, and supplies the summed up data to the second multiplying unit at the "q"th stage in the product-sum operation unit and to the delay unit the (q+1)th stage in the product-sum operation unit;

the resonance tone generating apparatus is connected with an electronic musical instrument provided with a damper pedal; and the resonance tone generating apparatus further comprises a multiplication coefficient controlling unit for controlling at least one of the first and second multiplication coefficients of the first and second multiplying units in the feed back unit to increase as the damper pedal is pressed down toward the floor.

* * * * *